US008393095B2

(12) United States Patent
Wagger et al.

(10) Patent No.: US 8,393,095 B2
(45) Date of Patent: Mar. 12, 2013

(54) ROTARY SNOW TILLER AND SKI SLOPE GROOMING METHOD

(75) Inventors: Klaus Wagger, Brunico (IT); Jan Müller, Vipiteno (IT)

(73) Assignee: Rolic Invest S.AR. L., Luxembourg (LU)

( * ) Notice: Subject to any disclaimer, the term of this patent is extended or adjusted under 35 U.S.C. 154(b) by 181 days.

(21) Appl. No.: 12/740,893

(22) PCT Filed: Oct. 29, 2008

(86) PCT No.: PCT/EP2008/064692
§ 371 (c)(1),
(2), (4) Date: Aug. 13, 2010

(87) PCT Pub. No.: WO2009/056576
PCT Pub. Date: May 7, 2009

(65) Prior Publication Data

US 2011/0005107 A1 Jan. 13, 2011

(30) Foreign Application Priority Data

Oct. 30, 2007 (IT) ..... MI2007A2091

(51) Int. Cl.
*E01H 5/04* (2006.01)

(52) U.S. Cl. ..... 37/223

(58) Field of Classification Search ..... 37/196, 37/209, 219–223, 348; 172/68–72
See application file for complete search history.

(56) References Cited

U.S. PATENT DOCUMENTS

| | | | |
|---|---|---|---|
| 3,170,533 | A | 2/1965 | Fewel et al. |
| 3,227,295 | A | 1/1966 | Hamilton et al. |
| 3,386,778 | A | 6/1968 | Rymes |
| 3,534,701 | A | 10/1970 | Hebert |
| 3,692,132 | A | 9/1972 | Pollanen |
| 3,763,944 | A | 10/1973 | Kaltenegger |
| 4,087,135 | A | 5/1978 | Unruh |
| 4,348,825 | A | 9/1982 | Bachler |
| 4,458,954 | A | 7/1984 | Haas |
| 4,458,955 | A | 7/1984 | Webb |
| 4,500,139 | A | 2/1985 | Tucek |
| 4,788,783 | A | 12/1988 | Bachler |
| 5,062,493 | A | 11/1991 | Platter et al. |

(Continued)

FOREIGN PATENT DOCUMENTS

| | | |
|---|---|---|
| CA | 2211050 | 1/1998 |
| CA | 2443765 A1 | 4/2004 |

(Continued)

OTHER PUBLICATIONS

PistenBully 600 brochure, written by Kassbohrer Gelandefahrzeug AG, published in Mar. 2010.

(Continued)

*Primary Examiner* — Robert Pezzuto
(74) *Attorney, Agent, or Firm* — Neal, Gerber & Eisenberg LLP

(57) ABSTRACT

A rotary snow tiller, for grooming the snow covering of ski slopes, which advances in a traveling direction along the ski slope, and has a frame; a shaft fitted with teeth and rotated with respect to the frame about an axis crosswise to the traveling direction; and an actuating device for imparting a reciprocating movement to the shaft with respect to the frame.

20 Claims, 3 Drawing Sheets

U.S. PATENT DOCUMENTS

| | | | | |
|---|---|---|---|---|
| 5,067,263 | A | | 11/1991 | Pelletier |
| 5,809,671 | A | * | 9/1998 | Sinykin ..... 37/219 |
| 6,155,363 | A | | 12/2000 | Matsumoto et al. |
| 6,296,330 | B1 | | 10/2001 | Hall |
| 6,354,023 | B1 | | 3/2002 | Trahan et al. |
| 6,418,645 | B1 | | 7/2002 | Hammerle et al. |
| 6,637,134 | B2 | | 10/2003 | Hammerle |
| 6,810,609 | B2 | | 11/2004 | Lassonde et al. |
| 6,921,304 | B2 | | 7/2005 | Hewitt |
| 6,983,927 | B2 | | 1/2006 | Pelletier et al. |
| 7,464,699 | B2 | | 12/2008 | Joppig et al. |
| 7,530,547 | B2 | | 5/2009 | Leitner et al. |
| 2002/0139013 | A1 | | 10/2002 | Hammerle |
| 2003/0051376 | A1 | | 3/2003 | Lassonde et al. |
| 2003/0159840 | A1 | | 8/2003 | Schmidt, Jr. |
| 2004/0069981 | A1 | | 4/2004 | Pelletier et al. |
| 2005/0252592 | A1 | | 11/2005 | Albright et al. |
| 2005/0279980 | A1 | | 12/2005 | Leitner et al. |
| 2007/0130806 | A1 | | 6/2007 | Goodman |
| 2008/0257616 | A1 | | 10/2008 | Olsson |
| 2008/0269986 | A1 | | 10/2008 | Regnell et al. |
| 2008/0309157 | A1 | | 12/2008 | Runggaldier et al. |
| 2009/0000833 | A1 | | 1/2009 | Dorais et al. |
| 2009/0007461 | A1 | | 1/2009 | Pelletier et al. |
| 2009/0013562 | A1 | | 1/2009 | Pelletier |

FOREIGN PATENT DOCUMENTS

| | | | |
|---|---|---|---|
| DE | 2145772 | | 3/1973 |
| DE | 2148304 | | 4/1973 |
| DE | 2219623 | | 11/1973 |
| DE | 2254276 | | 5/1974 |
| DE | 3440491 | | 5/1986 |
| DE | 3534626 | | 3/1987 |
| DE | 29515866 | | 1/1996 |
| DE | 29603251 | | 4/1996 |
| DE | 10320523 | | 11/2004 |
| EP | 0551160 | A1 | 7/1993 |
| EP | 1405782 | | 4/2004 |
| EP | 1674382 | A1 | 10/2005 |
| EP | 1591350 | A2 | 11/2005 |
| EP | 1827954 | B1 | 12/2005 |
| EP | 1995159 | A1 | 6/2007 |
| EP | 1872683 | A1 | 1/2008 |
| EP | 1908673 | B1 | 9/2009 |
| EP | 1908672 | B1 | 4/2010 |
| FR | 2336292 | | 7/1977 |
| FR | 2536437 | | 5/1984 |
| FR | 2586727 | | 3/1987 |
| GB | 1590358 | | 6/1981 |
| JP | 01144287 | | 10/1989 |
| JP | 03182887 | | 8/1991 |
| JP | 7237566 | | 9/1995 |
| WO | WO2005093173 | | 10/2005 |
| WO | WO2006069671 | | 7/2006 |
| WO | WO2006069682 | | 7/2006 |
| WO | WO2008114138 | | 9/2008 |
| WO | WO2008155423 | | 12/2008 |
| WO | WO2008155425 | | 12/2008 |
| WO | WO2009034183 | | 3/2009 |
| WO | WO2009034185 | | 3/2009 |
| WO | WO2009056577 | | 5/2009 |
| WO | WO2009056578 | | 5/2009 |
| WO | WO2009056579 | | 5/2009 |

OTHER PUBLICATIONS

PistenBully Scout brochure, written by Kassbohrer Gelandefahrzeug AG, published in Jan. 2010.

* cited by examiner

D1
D3
A1
A3
M
1
2
3
4
5
7
12
15
21
22
23
24
25
26
27
28
29

ROTARY SNOW TILLER AND SKI SLOPE GROOMING METHOD

PRIORITY CLAIM

This application is a national stage application of PCT/EP2008/064692, filed on Oct. 29, 2008, which claims the benefit of and priority to Italian Patent Application No. MI2007A 002091, filed on Oct. 30, 2007, the entire contents of which are incorporated herein.

TECHNICAL FIELD

The present disclosure relates to a rotary snow tiller for grooming ski slopes.

BACKGROUND

Known rotary snow tillers for grooming ski slopes normally advance in a traveling direction along the ski slope, and comprise a frame; and a toothed shaft rotated with respect to the frame about an axis crosswise to the traveling direction.

Such known rotary snow tillers have proved particularly effective in grooming ski slopes. The snow covering, however, varies considerably with weather conditions, snowfall and, particularly, daily variations in temperature. In the case of a steep temperature swing on either side of zero degrees, the snow covering forms an icy surface crust which, when particularly thick, impairs performance, in terms of quality grooming, of these known rotary snow tillers.

SUMMARY

It is an object of the present disclosure to provide a rotary snow tiller for grooming ski slopes, configured to eliminate certain of the drawbacks of the above-described known rotary snow tillers in a straightforward, low-cost manner, and in particular to effectively groom icy snow coverings.

According to the present disclosure, there is provided a rotary snow tiller, for grooming the snow covering of ski slopes, which advances in a traveling direction along the ski slope, and comprises a frame; and a shaft fitted with teeth and rotated with respect to the frame about an axis crosswise to the traveling direction; the rotary snow tiller being characterized by comprising an actuating device for imparting a reciprocating movement to the shaft with respect to the frame.

According to the present disclosure, the icy snow covering is broken up not only by conventional tilling action, but also by vibration of the teeth which interact with the icy snow covering as they sink into it.

The present disclosure also relates to a ski slope snow grooming method.

According to the present disclosure, there is provided a method of grooming the snow covering of ski slopes; the method comprising the step of tilling the snow covering using a rotary snow tiller advanced in a traveling direction and comprising a frame, and a shaft fitted with teeth and rotated about an axis; the method also comprising imparting a reciprocating movement to said shaft with respect to the frame.

Additional features and advantages are described in, and will be apparent from, the following Detailed Description and the figures.

BRIEF DESCRIPTION OF THE DRAWINGS

A number of non-limiting embodiments of the present disclosure will be described by way of example with reference to the accompanying drawings, in which.

DETAILED DESCRIPTION

Figure 1:
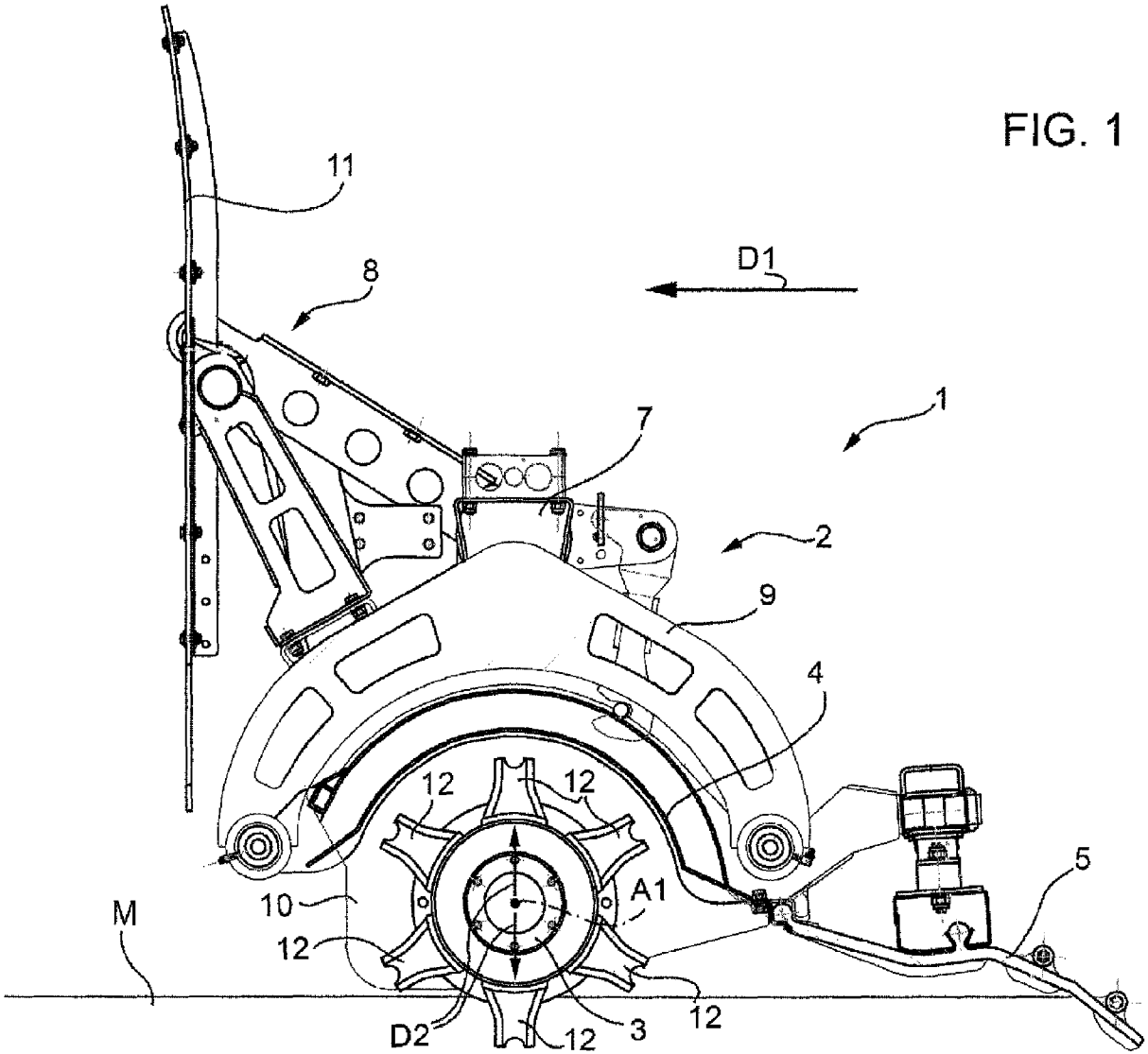
FIG. 1 shows a side view, with parts removed for clarity, of a rotary snow tiller for grooming ski slopes, in accordance with the present disclosure.

Referring now to the example embodiments of the present disclosure illustrated in FIGS. 1 to 5, number 1 in FIG. 1 indicates as a whole a rotary snow tiller for grooming the snow covering M of ski slopes, and which is towed in a traveling direction D1 by a snow groomer vehicle (not shown in the drawings).

Rotary snow tiller 1 is configured to till a surface layer of snow covering M, and comprises a frame 2; a shaft 3 rotated with respect to frame 2 about an axis A1 crosswise to traveling direction D1; a protective casing 4 surrounding shaft 3 rotating about axis A1 crosswise to traveling direction D1; a flexible finish mat 5 which is connected to casing 4, extends behind shaft 3, and is drawn over the surface of the tilled snow covering M; and an actuating device 6 (FIGS. 2 and 3) located between shaft 3 and frame 2 to impart a reciprocating movement to shaft 3.

Frame 2 comprises a bar 7 parallel to axis A1; a hitch device 8 fixed to bar 7 and for connecting tiller 1 to the snow groomer vehicle (not shown); two arc-shaped segments 9 (only one shown) fixed transversely to bar 7; and two plates 10 (only one shown in FIG. 1) for supporting shaft 3.

Rotary snow tiller 1 comprises two adjustable panels 11 (only one shown in FIG. 1) which act to a certain extent as splash guards to protect casing 4 and finish mat 5 from the snow thrown up by the groomer vehicle (not shown in the drawings).

Shaft 3 comprises a number of teeth 12 equally spaced about and along axis A1, and each of which projects radially from shaft 3 to penetrate snow covering M.

The length of shaft 3 defines the work range and the width of tiller 1 as a whole.

Figure 2:
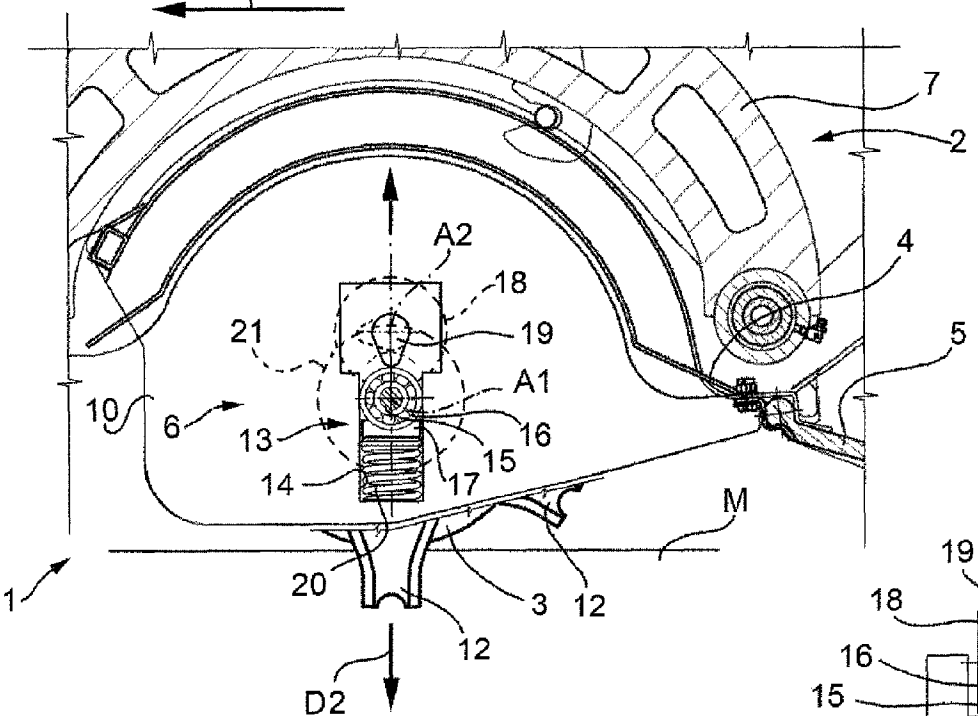
FIG. 2 shows a partly sectioned side view, with parts removed for clarity, of a detail of the FIG. 1 rotary snow tiller.
Figure 3:
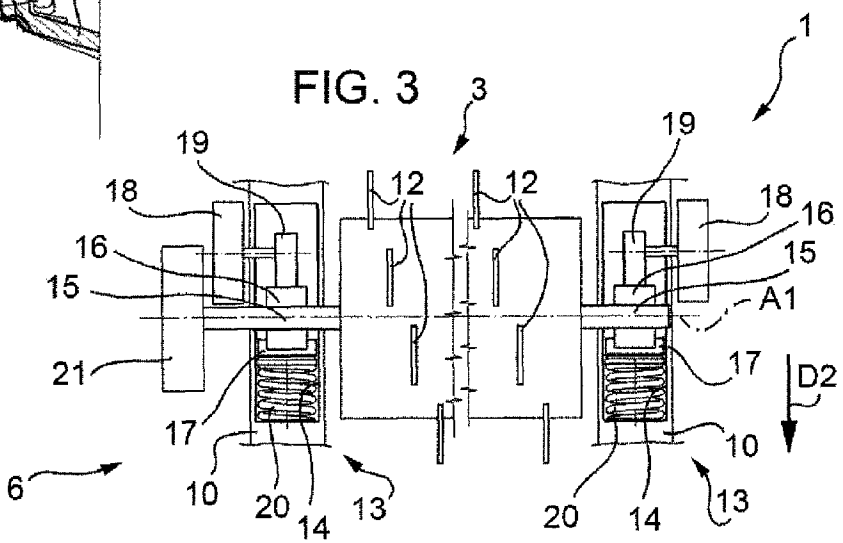
FIG. 3 shows a schematic, partly sectioned front view, with parts removed for clarity, of a detail of the FIG. 2 rotary snow tiller.

With reference to FIGS. 2 and 3, rotary snow tiller 1 comprises a guide assembly 13 for guiding shaft 3 in a direction D2 crosswise to traveling direction D1 and to axis A1 of shaft 3, and which comprises two guides 14 (only one shown in FIG. 2) integral with frame 2. In the FIGS. 2 and 3 example, guides 14 are two grooves formed in plates 10. Shaft 3 comprises two ends 15 and in the illustrated example, two end pins which slide inside respective grooves 14 in direction D2.

More specifically, and with reference to FIG. 3, guide assembly 13 comprises two bearings 16 fitted to respective ends 15 of shaft 3; and two slides 17, each fitted in sliding manner to a respective guide 14 and in rotary manner to a respective end 15 of shaft 3.

Actuating device 6 comprises a rotary actuator 18 associated with frame 2 and connected to a respective end 15 of shaft 3 by a mechanism or rotator 19, which, in the example shown, is defined by a cam supported by a respective plate 10 to rotate about an axis A2 parallel to axis A1; and an elastic member 20 located between frame 2 and end 15 of shaft 3, and which, in the example shown, is a spring, in particular a coil spring, for pushing slide 17, bearing 16, and end 15 of shaft 3 against mechanism 19.

FIG. 3 shows two actuating devices, which are operated synchronously, and each of which is located at a respective end of the shaft.

One end 15 of shaft 3 is connected to a hydraulic motor 21 for rotating shaft 3 about axis A1.

In actual use, rotary snow tiller 1 is drawn along the ski slope in traveling direction D1 by a snowgroomer vehicle (not shown) to till snow covering M. Shaft 3 is rotated, such as anticlockwise or counterclockwise of FIG. 1, about axis A1 by hydraulic motor 21 to till snow covering M, which is then smoothed by finish mat 5. In addition to rotating about axis A1, shaft 3 is selectively moved back and forth in direction D2, crosswise to traveling direction D1 and to axis A1, by actuating devices 6.

Teeth 12 of shaft 3 thus rotate and also perform a reciprocating movement which allows or enables teeth 12 to break easily through the icy crust and effectively till snow covering M.

More specifically, mechanisms or rotators 19 (i.e., the cams), are rotated synchronously about axes A2 to impart a reciprocating movement to shaft 3.

Alternatively, the movement in direction D2 is imparted by a single rotary actuator connected to both ends of the shaft by a mechanical transmission.

Figures 4, 5:
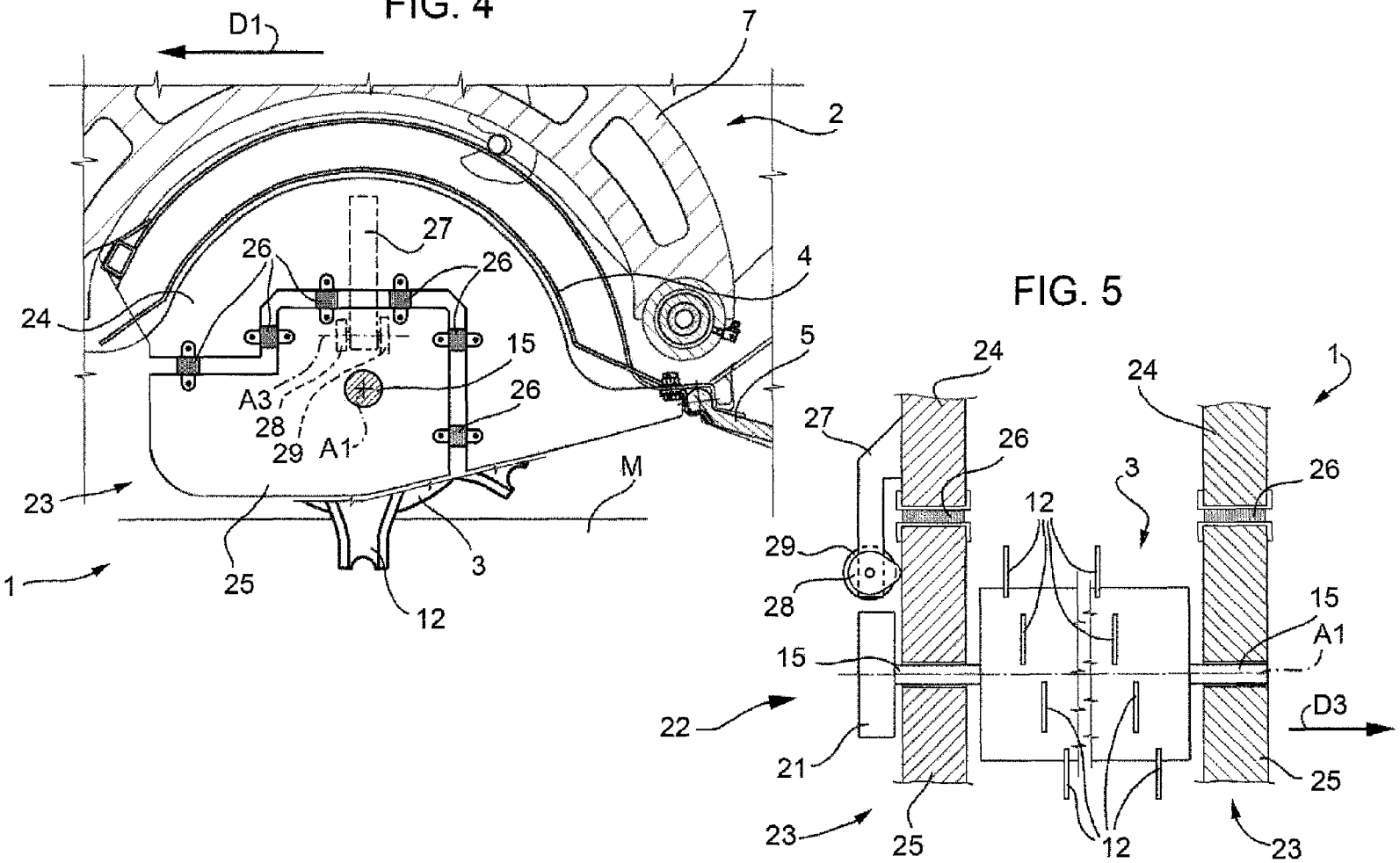
FIG. 4 shows a partly sectioned side view, with parts removed for clarity, of a variation of the FIG. 2 rotary snow tiller.
FIG. 5 shows a schematic, partly sectioned front view, with parts removed for clarity, of a detail of the FIG. 4 rotary snow tiller.

In another embodiment illustrated in FIGS. 4 and 5, actuating devices 6 are replaced by an actuating device 22, which imparts a reciprocating movement to shaft 3 in a direction D3 substantially parallel to axis A1 of shaft 3.

In this embodiment, each supporting plate 10 is replaced by a supporting plate 23, which comprises a portion 24 integral with frame 2; and a portion 25 movable with respect to frame 2 and connected to portion 24 by elastic anchors 26, each of which is connected to portion 24 and portion 25 by respective brackets. Each portion 25 is connected to a respective end 15 of shaft 3, such as by bearings (not shown in FIGS. 4 and 5).

Actuating device 22 comprises a bracket 27 fixed to portion 24 and extending along portion 25; a mechanism or rotator 28 defined, in the example shown, by a cam rotated about an axis A3 crosswise to axis A1; and a rotary actuator 29 defined, in the example shown, by a hydraulic actuator for operating mechanism 29.

Rotation of mechanism 28 about axis A3 produces a reciprocating movement of shaft 3 substantially in direction D3 parallel to axis A1.

In another embodiment (not shown), rotary snow tiller 1 comprises two actuating devices 22 located at two opposite plates 23 and synchronized to produce a reciprocating movement of shaft 3 in direction D3.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A snow grooming rotary snow tiller comprising:

a frame;

a shaft supported by the frame, said shaft fitted with a plurality of teeth and configured to rotate about a first axis crosswise to a direction that the frame is configured to travel along a ski slope; and an actuating device including at least a first rotary actuator fixed to the frame and connected to the shaft by a rotary cam, said actuating device configured to impart a reciprocating movement to the shaft with respect to the frame.

2. The snow grooming rotary snow tiller of claim 1, which includes:

two bearings, each bearing fitted to an opposite end of the shaft; and two slides, each slide connected to a respective one of the bearings and slideably connected to a respective guide.

3. The snow grooming rotary snow tiller of claim 1, which includes a plurality of elastic members located between the frame and the shaft, said elastic members being configured to push the shaft against the rotary cam.

4. The snow grooming rotary snow tiller of claim 1, which includes a guide assembly configured to guide the shaft with respect to the frame in a direction perpendicular to the direction that the frame is configured to travel and perpendicular to the first axis.

5. The snow grooming rotary snow tiller of claim 4, wherein the guide assembly includes two guides connected to the frame and two ends of the shaft are each slidably connected to one of the respective guides.

6. The snow grooming rotary snow tiller of claim 1, which includes a plurality of actuating devices, at least one of the actuating devices fitted to each respective end of the shaft.

7. The snow grooming rotary snow tiller of claim 1, wherein the shaft is moveably connected to the frame in a direction substantially parallel to the first axis and said actuating device is configured to impart the reciprocating movement in a direction parallel to the first axis.

8. A snow grooming rotary snow tiller comprising:

a frame;

a shaft supported by the frame, said shaft fitted with a plurality of teeth and configured to rotate about a first axis; and an actuating device including at least a first rotary actuator fixed to the frame and connected to the shaft by a rotary cam, said actuating device configured to cause the shaft to move toward and away from a top of the frame.

9. The snow grooming rotary snow tiller of claim 8, which includes:

two bearings, each bearing fitted to an opposite end of the shaft; and two slides, each slide connected to a respective one of the bearings and slideably connected to a respective guide.

10. The snow grooming rotary snow tiller of claim 8, which includes a plurality of elastic members located between the frame and the shaft, said elastic members being configured to push the shaft against the rotary cam.

11. The snow grooming rotary snow tiller of claim 8, which includes a plurality of actuating devices, at least one of the actuating devices fitted to each respective end of the shaft.

12. A method of grooming a snow covering of a ski slope, said method comprising:

tilling the snow covering using a tiller advanced in a direction of travel along a ski slope, said tiller including:

a frame, and a shaft fitted with a plurality of teeth and configured to rotate about a first axis, and imparting a reciprocating movement to said shaft, said reciprocating movement to the shaft being in a direction perpendicular to the direction of travel and perpendicular to the first axis.

13. A snow grooming rotary snow tiller comprising:

a frame;

a shaft supported by the frame, said shaft fitted with a plurality of teeth and configured to rotate about a first axis crosswise to a direction that the frame is configured to travel along a ski slope;

an actuating device configured to impart a reciprocating movement to the shaft with respect to the frame; and a guide assembly including two guides connected to the frame and two ends of the shaft are each slidably connected to one of the respective guides, said guide assembly configured to guide the shaft with respect to the frame in a direction perpendicular to the direction that the frame is configured to travel and perpendicular to the first axis.

14. The snow grooming rotary snow tiller of claim 13, which includes a plurality of actuating devices, at least one of the actuating devices fitted to each respective end of the shaft.

15. The snow grooming rotary snow tiller of claim 13, wherein the shaft is moveably connected to the frame in a direction substantially parallel to the first axis and said actuating device is configured to impart the reciprocating movement in a direction parallel to the first axis.

16. A snow grooming rotary snow tiller comprising:

a frame;

a shaft supported by the frame, said shaft fitted with a plurality of teeth and configured to rotate about a first axis crosswise to a direction that the frame is configured to travel along a ski slope; and a plurality of actuating devices, at least one of the actuating devices fitted to each respective end of the shaft and configured to impart a reciprocating movement to the shaft with respect to the frame.

17. The snow grooming rotary snow tiller of claim 16, wherein the shaft is moveably connected to the frame in a direction substantially parallel to the first axis and at least one of said actuating devices is configured to impart the reciprocating movement in a direction parallel to the first axis.

18. A snow grooming rotary snow tiller comprising:

a frame;

a shaft supported by the frame, said shaft fitted with a plurality of teeth, said shaft configured to rotate about a first axis crosswise to a direction that the frame is configured to travel along a ski slope, and said shaft is moveably connected to the frame in a direction substantially parallel to the first axis; and an actuating device configured to impart a reciprocating movement to the shaft with respect to the frame, said reciprocating movement being in a direction parallel to the first axis.

19. A snow grooming rotary snow tiller comprising:

a frame;

a shaft supported by the frame, said shaft fitted with a plurality of teeth and configured to rotate about a first axis; and a plurality of actuating devices, at least one of the actuating devices fitted to each respective end of the shaft and configured to cause the shaft to move toward and away from a top of the frame.

20. A method of grooming a snow covering of a ski slope, said method comprising:

tilling the snow covering using a tiller advanced in a direction of travel along a ski slope, said tiller including:

a frame, and a shaft fitted with a plurality of teeth and configured to rotate about a first axis, and imparting a reciprocating movement to said shaft, said reciprocating movement to the shaft being in a direction substantially parallel to the first axis.

* * * * *